United States Patent [19]

Hendrich

[11] Patent Number: 4,479,333

[45] Date of Patent: Oct. 30, 1984

[54] FOLDED BUILDING MODULE AND METHOD OF ASSEMBLY

[76] Inventor: John H. Hendrich, 4851 Wolf Rd., Erie, Pa. 16505

[21] Appl. No.: 299,816

[22] Filed: Sep. 8, 1981

Related U.S. Application Data

[63] Continuation of Ser. No. 17,436, Mar. 5, 1979, abandoned.

[51] Int. Cl.[3] ..... E04B 1/346

[52] U.S. Cl. ..... 52/70; 52/641; 52/645; 52/646

[58] Field of Search ..... 52/66, 70, 71, 645, 52/641, 745, 90, 646; 46/19, 21; 119/19

[56] References Cited

U.S. PATENT DOCUMENTS

| | | | |
|---|---|---|---|
| 3,280,796 | 10/1966 | Hatcher | 119/19 |
| 3,324,831 | 6/1967 | Onge | 119/19 |
| 3,434,253 | 3/1969 | Hatcher | 52/70 X |
| 3,494,092 | 2/1970 | Johnson et al. | 52/745 |
| 3,968,618 | 7/1976 | Johnson | 52/69 X |
| 3,971,185 | 7/1976 | Hendrich | 52/71 X |
| 4,195,593 | 4/1980 | Dunn | 52/70 X |

*Primary Examiner*—Carl D. Friedman

*Attorney, Agent, or Firm*—Dana F. Bigelow

[57] ABSTRACT

A building module of folded structural elements pivotably interconnected and unfoldable to present a building structure. A floor element and a pair of roof elements are connected in series by a pair of pivots and the combination is folded for transportation to a building site where the floor element can be placed on supports and the roof elements rotated to jointly form an angled roof component. A pair of wall elements may also be attached to and folded against the floor element such that when they are unfolded they form vertical walls and act to support the roof element.

28 Claims, 51 Drawing Figures

FOLDED BUILDING MODULE AND METHOD OF ASSEMBLY

This application is a continuation for application Ser. No. 017,436, filed Mar. 5, 1979, now abandoned.

BACKGROUND OF THE INVENTION

This invention relates generally to building structures and, more particularly, to building modules and methods of erecting a building structure from such modules.

The building construction industry has long recognized the desirability of standardizing certain construction designs and techniques, and of using these designs and techniques to preconstruct in a controlled environment certain elements or modules of a building structure for subsequent transportation to a building site where they are assembled with a minimum amount of labor, equipment, and time. In this way, most of the actual construction and assembly work can be conducted under planned and favorable conditions such as exist in a factory, or the like, while final erection at diverse sites of unplanned and possibly unfavorable conditions can be accomplished with little dependence on a skilled labor force, favorable weather conditions, and large amounts of equipment, materials, supplies, and time.

Generally, in accordance with current practice, a building is designed to comprise a plurality of substantially planar parts or panels, such as wall panels and ceiling panels. These panels are constructed at a central factory, packaged into building modules comprising a plurality of such panels, and then transported in a stacked or folded condition to the building site where they are unstacked, unfolded, and erected in combination to form the final building structure. Various such modules and methods of erection are shown in U.S. Pat. Nos. 3,863,419; 3,971,185; and 3,953,947 issued to the Applicant of the present invention.

One of the features exhibited by certain prior art modules and methods of construction, including those of the patents cited hereinabove, is that of having an established base in order to connect a portion of the module thereto for subsequent pivoting of the module elements thereabout. To be more specific, many of the prior art modules are dependent on the having in place at the construction site a completed base or foundation structure such as a concrete slab, or the like. Others, such as those disclosed in the patents mentioned hereinabove, rely on a pair of spaced bases which are used for final connection after unfolding the module.

It is, therefore, an object of the present invention to provide an improved building module and method of erecting same.

Another object of the present invention is the provision for a building module which can be economically manufactured and assembled in a factory environment.

Still another object of the present invention is the provision for a building module which can be easily packaged for transportation to a building site.

Yet another object of the present invention is the provision for a building module which can be erected at a building site in a practical and efficient manner.

Still another object of the present invention is the provision for a building module which can be erected without the use of base supports from which portions are pivoted thereabout.

Still a further object of the present invention is the provision for a building module which can be folded, transported to a building site, and erected in its entirety, without the need for separate, prior or subsequent construction of base or floor members.

These objects and other features and advantages become more readily apparent upon reference to the following description when taken in conjunction with the appended drawings.

SUMMARY OF THE INVENTION

Briefly, in accordance with one aspect of the invention, a building module comprises a floor element and two roof elements, each element being constructed in a rigid planar panel. The floor element is hingedly connected at its one end to one of the roof elements, and the other roof element is hingedly connected to the other end of that roof element. The hinges allow the panels to be disposed in stacked horizontal array for transportation to the building site whereupon the module can be placed with the floor element resting on the ground and the two roof elements can be rotated to jointly form an angled roof component. The free end of the one roof component can then be connected to the free end of the floor element to form a completed A-frame structure.

By another aspect of the invention, the three-panel module, as described hereinabove, may be selectively placed on a pair of spaced vertical walls to form the superstructure of the completed building, with the horizontal or floor element serving to function as the ceiling and the structural interconnection between the two otherwise unsupported walls.

By yet another aspect of the invention, the module includes, in addition to the floor and roof panels, a pair of wall panels hingedly connected to the floor panel and foldable to a substantially horizontal position. Erection is then accomplished by first erecting the A-frame portion, as described hereinabove, and then further lifting the module to unfold the wall panels downwardly into a generally vertical position where they may then rest on the ground or other suitable foundation or, alternately, unfolding the wall panels and then erecting the A-frame portion.

In the drawings, as hereinafter described, a preferred embodiment and various alternate embodiments are depicted; however, various other modifications and alternate constructions can be made thereto without departing from the true spirit and scope of the invention.

DESCRIPTION OF THE PREFERRED EMBODIMENT

Figure 1:
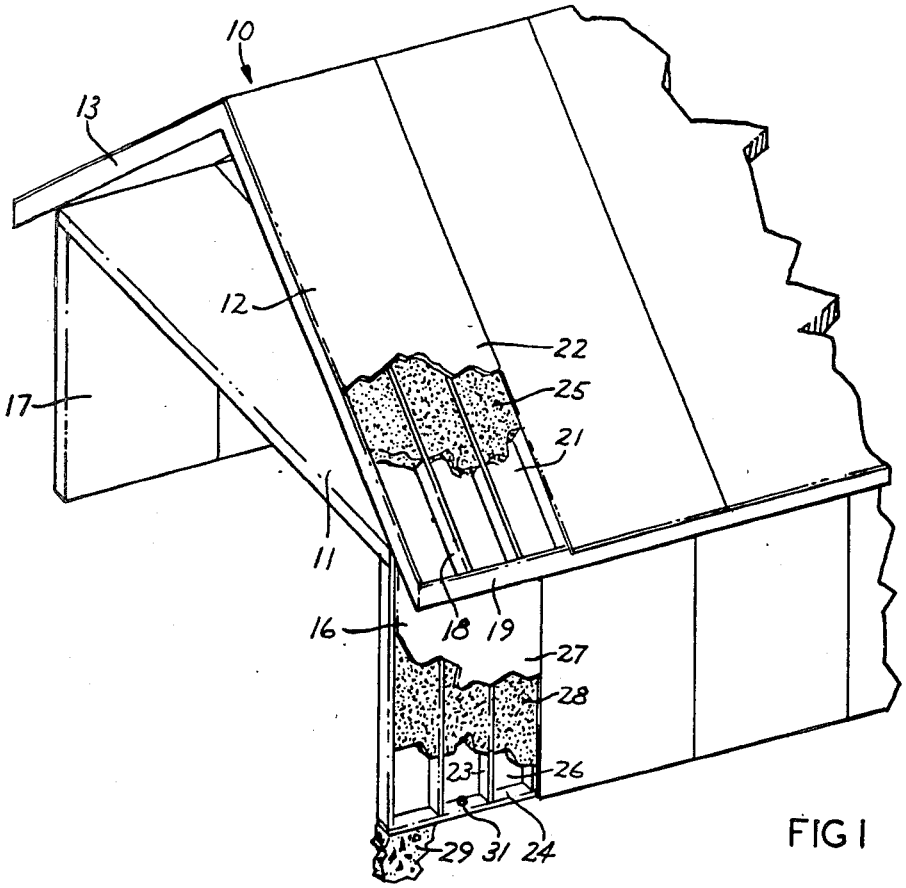
FIG. 1 is a schematic illustration of a building structure comprising of building modules in accordance with the preferred embodiment of the invention.
Figure 2A:
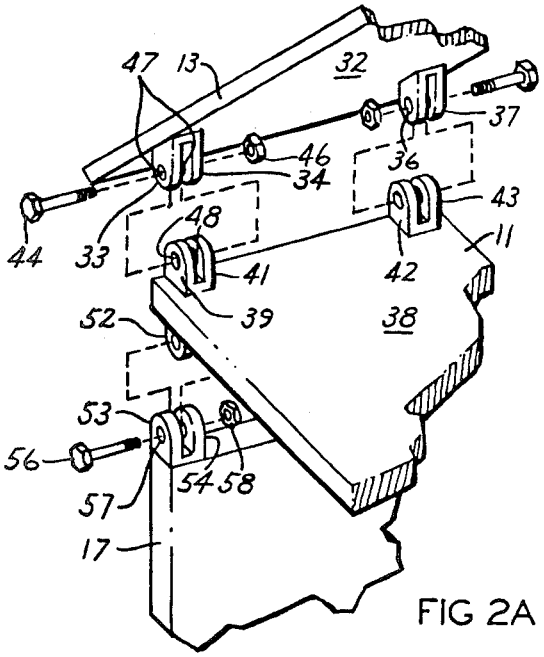
FIGS. 2, 3, and 4 are partial views thereof showing various embodiments of a hinged portion thereof.

Referring now to FIG. 1, the building module of the present invention is shown generally at 10 as used in combination with a plurality of like modules to comprise a building structure having side walls, a ceiling, and a roof. The building structure can be of any size and may include any number of the building modules 10 with the modules being connected in an end-to-end relationship by conventional means, such as brackets and fasteners, or the like. For purposes of clarity and simplicity, the invention will be described in terms of a single module, it being understood that most building structures will comprise a plurality of interconnected modules. The depth or width of the individual modules is dependent primarily on means by which they are transported since this is the primary sizing limitation. For example, a module having an extensive length can easily be accommodated by a truck or a rail car, but the width, in such cases, would be necessarily limited to a relatively smaller dimension.

Each of the modules 10 comprises a floor or ceiling element 11, a pair of roof elements 12 and 13, and a pair of side wall elements 16 and 17. The details of module construction and the types of materials used can, of course, be varied substantially, depending on the requirements for life, durability, strength, and the like; however, strictly for the purpose of illustrating one possible embodiment of the invention, the roof elements 12 and 13 comprise a plurality of longitudinally spaced rafters 18 interconnected at their ends by frame members 19 to form a rectangular framework. The rafters and frame members may be of various materials, such as wood or metal I-beams, or the like. An internal covering 21 is placed on one side of the framework and an outer covering 22 on the outer side thereof to complete the roof panel structure. These coverings may comprise a single layer of material, such as plywood, sheet metal, or the like, or they may comprise a combination of materials, such as plywood covered with plasterboard. It will be understood that the panels are preferably fabricated in their entirety at the factory; however, it may be desirable to complete certain portions of the panels after they are at the building site. For example, it may be desirable to install insulation 25 between the inner and outer coverings 22 while the panel is being assembled at the factory or, alternatively, it may be desirable to instead wait until the structure is erected and then blow the insulation into the completed panels.

Referring now to the side wall elements 16 and 17, they are shown to be similarly constructed having longitudinally spaced vertically aligned studs 23 interconnected at their bottoms by a footer 24 and at their tops by a header not shown. An inner covering 26 and an outer covering 27 are applied with insulation 28 being provided therebetween. Again, the particular materials and the degree of completion can be varied to accommodate the particular building requirements. The footers 24 are placed on a suitable base 29 such as a concrete foundation, and are preferably permanently attached by a plurality of bolts 31, or the like.

The ceiling element 11 is constructed in a manner similar to that of the roof elements 12 and 13 and the side wall elements 16 and 17.

Interconnection of the various panels, described hereinabove, is made by way of hinges or pivot elements in a manner which allows the panels to be folded in a generally horizontal array such that the modules can then be stacked for transportation to a site and then be erected by simply lifting the modules with a crane, or the like, and unfolding the various panels at their hinged joints to obtain a building structure. The manner in which these modules are folded and subsequently pivoted during erection will be more fully described hereinafter.

Referring now to FIGS. 2–6, there are shown various configurations of hinging arrangements whereby the respective panels can be so folded at the factory and later unfolded and erected at the site. Directing attention first to FIGS. 2A and 2B, the roof panel 13 is shown to have attached on its inner side 32 a pair of spaced brackets 33 and 34 near its forward edge and another pair of spaced brackets 36 and 37 attached near its rear edge. Similarly, on the upper surface 38 of the ceiling element 11, there are attached bracket elements 39 and 41 near its forward edge and brackets 42 and 43 near the rear edge thereof. The brackets are so placed and aligned such that those on the roof panel 13 and those on the ceiling panel 11 can be rotatably interconnected by fastening means such as a bolt and nut 44 and 46, respectively, passing through holes 47 and 48 formed in the respective brackets. Of course, it will be understood that the number of brackets, the particular placement thereof, and the type and design thereof can be varied significantly to satisfy the requirements of any particular installation. The hinge or pivot arrangement which results from a combination of brackets attached to the sides of adjacent panels, as described hereinabove, is shown generally at 49 in FIG. 2B. A somewhat modified pivot arrangement is shown generally at 51 of that figure wherein brackets 52 (see FIG. 2A) are again attached to one side of the ceiling element 11 but the side wall element 17, instead of having brackets attached to its one side, has the brackets 53 and 54 attached at its upper end, as shown. The brackets 53 and 54 are so positioned and spaced that they interconnect with the bracket 52 and are held together by a bolt 56 passing through the holes 57 and secured by a nut 58. It will be recognized that the pivot arrangement 51 allows the interconnected ceiling panel 11 and side wall panel 17 to be folded in a parallel relationship or in a substantially oppositely extending relationship, whereas the pivot arrangement 49 allows the interconnected ceiling 11 and roof 13 panels to be folded only in the parallel relationship. It should thus be noted that a particular type and position of hinge will depend on the preferred manner of folding, which will be more clearly described hereinafter.

Figure 3:
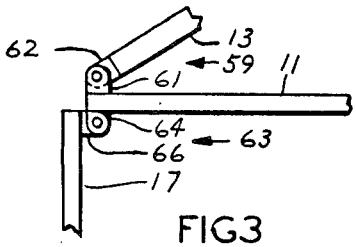
Figure 4:
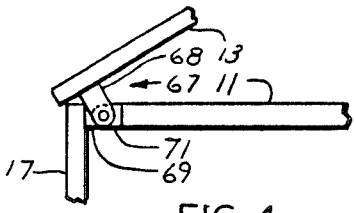

In FIGS. 3 and 4, there is shown other possible pivot arrangements that may be used. In the arrangement shown generally at 59, a bracket 61 connected to the one side of a ceiling element 11 interconnects with a bracket 62 attached to the upper side of the roof panel 13. Such an arrangement will allow the ceiling panel 11 and roof panel 13 to be placed in oppositely extending positions or in mutually parallel positions. The pivot arrangement 63 provides a bracket 64 on the underside of the ceiling element 11 and a bracket 66 on the inner side of the side wall element 17. Again, the arrangement 63 will allow folding of the two panels only in the generally parallel positions. The particular bracket arrangement shown generally at 67 of FIG. 4 provides a bracket 68 on the inner side of the roof panel 13, a bracket 69 on the inner side of the side wall panel 17, and a bracket 71 extending from the edge of the ceiling element 11. Such an arrangement will allow a folding of the panels only in the mutually parallel positions.

Figure 5:
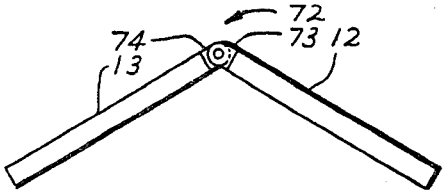
FIGS. 5 and 6 are partial views thereof showing various embodiments of another hinged portion thereof.
Figure 5A:
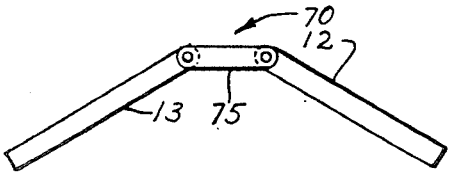
Figure 6:
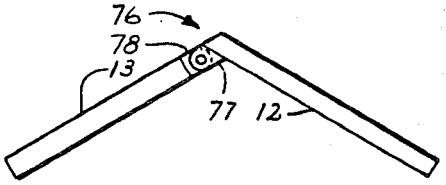

Referring now to the interconnection between the roof panels 12 and 13, there are shown in FIGS. 5, 5A, and 6 three of the various possible pivot arrangements.

The pivot arrangement shown generally at 72 shows interconnected brackets 73 and 74 attached at the ends of the roof panels 12 and 13, respectively. Such an arrangement allows the two panels to be placed in oppositely extending directions but not in generally parallel relationship. The pivot arrangement shown generally at 70 of FIG. 5A includes a link 75 which interconnects the panels 12 and 13 and allows them to be folded and rotated relatively over a range greater than 180 degrees. Of course, such an arrangement would require separate means to lock the link 70 from rotation after erection. The pivot arrangement shown generally at 76 in FIG. 6 includes a bracket 77 formed on the inner side of the roof panel 12 and a bracket 78 attached to the end of the roof element 13 such that the roof elements 12 and 13 can be placed in either the oppositely extending positions or in the generally parallel positions.

Figure 7:
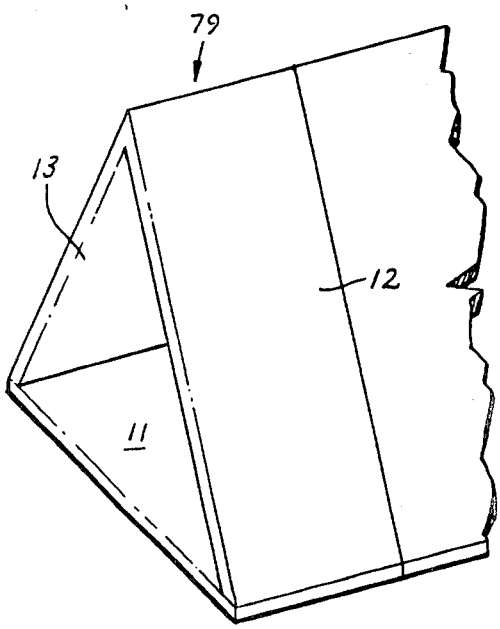
FIG. 7 is a perspective view of an A-frame structure in accordance with the preferred embodiment of the invention.
Figure 2B:
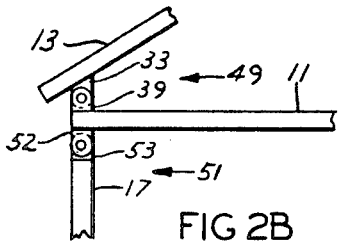

Thus far, the invention has been described in terms of a building module having a pair of roof panels, a ceiling panel, and a pair of side wall panels; however, in a more basic form of the invention, the building module comprises only the roof elements 12 and 13 along with the floor panel 11, the module being shown generally at 79 in FIG. 7. Again, any number of such modules can be connected in an end-to-end relationship to provide a building structure of any desired length. It will be readily seen that such a combination of modules provides, except for the end panels (not shown) which may be included in the module package, the complete building structure which can be placed on any suitable horizontal support surface or combination of surfaces such as a concrete foundation, a pair of spaced vertical walls such as those shown at 16 and 17 of FIG. 1, or even directly on the ground. A simple A-frame building could thus be erected by first preparing a flat level ground surface, placing a folded module on the ground surface and then rotating the roof panels 12 and 13 on the hinges or pivots in a manner to be described hereinafter, and then finally connecting the free end of the one ceiling panel 12 to the edge of the floor panel 11 by any suitable means similar to the hinge arrangements as discussed hereinabove. Another method of construction would involve first the erection of a pair of spaced vertical walls, a placing of the folded module with the ends of the floor panel 11 resting on the two vertical wall structures, and then again unfolding the roof panels 12 and 13 and connecting them in a manner similar to that of the A-frame structure. Still another method of erection would involve the use of a building module comprising the pair of roof elements 12 and 13, a floor or ceiling element 11, and the pair of side wall elements 16 and 17 all folded in a generally horizontal array. A suitable horizontal support surface or surfaces would first be provided and the entire module placed thereon. A crane or lifting apparatus would be attached to unfold the roof panels 12 and 13 and the one free end would be connected to the free end of the ceiling element 11. The entire module would then be further lifted and the side wall panels 16 and 17 would be folded downward to be connected to the horizontal support surface(s).

Referring now to FIGS. 8–19, there are shown various module configurations in their folded conditions. Also shown are the intermediate positions and the directions of rotation of each of the panels and the final positions of the panels when the module is in the finally erected condition. It should be kept in mind that the three-panel module may be placed directly on the ground, or other suitable base, or on spaced horizontal support surfaces to form a self-contained A-frame structure, or it may be placed on one or more vertical side wall elements to form a building second story or superstructure comprised of a ceiling and roof panels. However, strictly for simplicity in description, the module will be described in terms of application to a pair of spaced horizontal support surfaces.

Figure 8A:
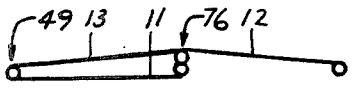
Figure 8B:
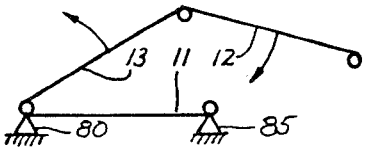
Figure 8C:
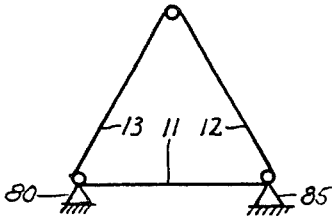

In FIG. 8, the building module is shown to include a floor or ceiling panel 11 having the roof panels 12 and 13 folded in parallel contiguous relationship on the upper side therewith. The floor panel 12 is connected to the roof panel 13 by a pivot arrangement 49, similar to that shown in FIG. 2B. The two roof panels 12 and 13 are interconnected by a pivot arrangement 76, similar to that shown in FIG. 6. Erection is accomplished by first placing the entire folded module on the horizontal support surfaces 80 and 85 and then, with the use of a crane or the like, rotating the roof panel 13 in the counterclockwise direction, and the roof panel 12 in the clockwise direction, as shown in FIG. 8B, and finally, connecting the free end of the roof element 12 to the free end of the floor panel 11, as shown in FIG. 8C.

Figure 9A:
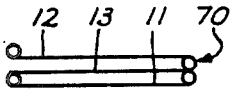
Figure 9B:
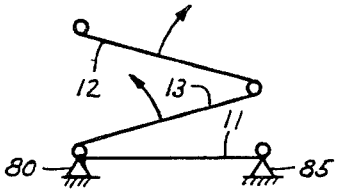
Figure 9C:
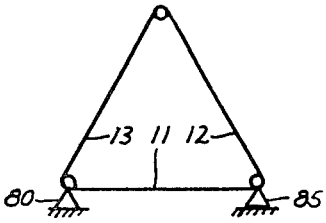

In FIG. 9, the folded module and method of erection is similar, except that the roof panel 12 is folded back in parallel relationship with the roof panel 13. Such a configuration will require a relative rotation of the roof panel 12 with respect to the roof panel 13 through an angle greater than 180 degrees and, therefore, will require a pivot arrangement—similar to that shown in FIG. 5A.

Figure 10A:
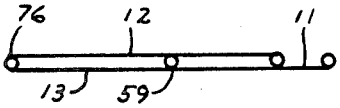
Figure 10B:
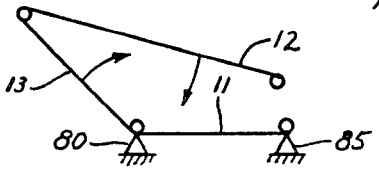
Figure 10C:
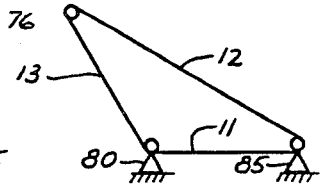

In the module configuration of FIG. 10, one of the roof panels 12 is substantially longer than the other roof panel 13 and the module is folded in such a way that both the other roof panel 13 and the floor panel 11 are disposed in parallel relationship with the roof panel 12. The pivot arrangements 59 and 76, similar to those of FIGS. 3 and 6, respectively, are used to interconnect the three panels and rotation and final connection is accomplished in the manner as shown in FIGS. 10B and 10C. It is suggested that such an arrangement might be desirable for use in combination with other types of modules to form a complete building structure. For example, the floor panel 11 might be placed on a pair of vertical walls to form a ceiling, and another structure connected to the pivot arrangement 76 such that the roof panel 13 might provide the ceiling structure for another room.

Figure 11A:
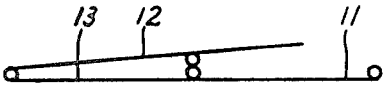
Figure 11B:
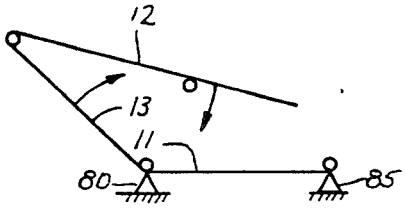
Figure 11C:
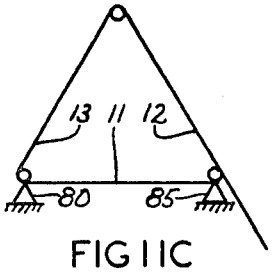

In FIG. 11, the module in the folded condition is identical to that of the FIG. 10 embodiment but instead of the free end of the roof panel 12 being connected to the free end of the floor panel 11, the roof panel 12 is allowed to extend downwardly below the level of horizontal support surfaces 80 and 85 such that it may form an eave or a roof section of another portion of the building structure. Final connection of the roof panel 12 may be made at an intermediate position, to the floor panel 11 or, alternatively, the free end of the roof panel 12 may be connected to another base (not shown).

Figure 12A:
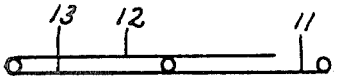
Figure 12B:
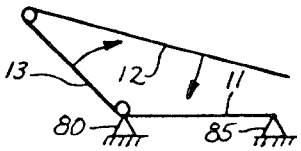
Figure 12C:
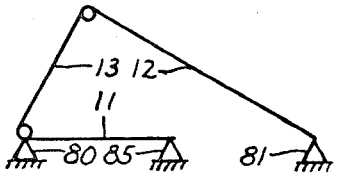

FIG. 12 shows a further method of erection wherein the free end of the roof panel 12 is finally attached to another horizontal support surface 81 which is in substantially the same horizontal plane as that of the other horizontal support surfaces 80 and 85.

Figure 13A:
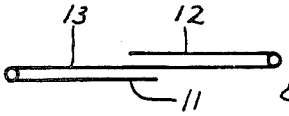
Figure 13B:
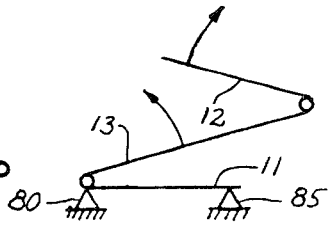
Figure 13C:
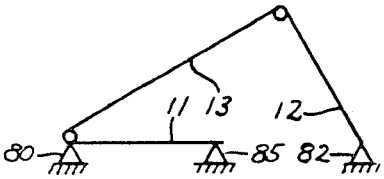

The building module of FIG. 13 is folded and unfolded in the same manner as that shown in FIG. 9 but the relative lengths of the panels are different from those of FIG. 9. Again, like the configuration of FIG.

12C, the roof panel 12 is finally attached to a horizontal support surface 82 which is spaced from but in the same horizontal plane as that of the two horizontal support surfaces 80 and 85 supporting the floor panel 11. In such a configuration, the roof panel 12 may be connected at its end similar to that of the FIG. 12C configuration, or it may be connected to the horizontal support surface 82 in a manner similar to the FIG. 11C arrangement such that a portion thereof extends downwardly as indicated by the dotted line. Again, such an arrangement might be desirable when the module is being placed on a vertical wall structure to form a building superstructure.

Figure 14A:
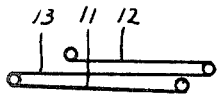
Figure 14B:
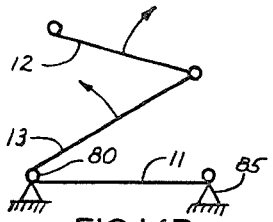
Figure 14C:
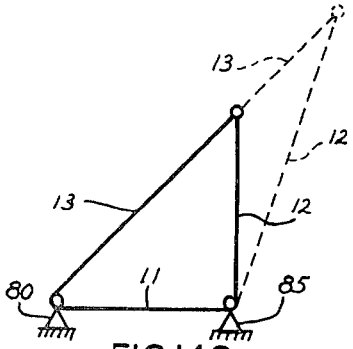

In FIG. 14, there is shown a configuration which is folded and unfolded in essentially the same manner as that of FIGS. 9 and 13. However, the roof panel 12 is connected at its free end to the free end of the floor panel 11 and the lengths of the respective panels are such that the floor and roof panels 11 and 12 form either a right angle, as shown by the solid lines, or an obtuse angle, as shown by the dotted lines.

Figure 15A:
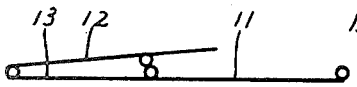
Figure 15B:
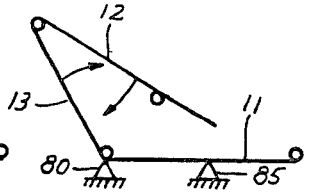
Figure 15C:
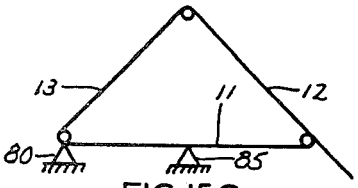

The building module of FIG. 15 is folded and unfolded in a manner similar to those of FIGS. 10, 11, and 12, but the horizontal support surface 83 is not placed at the end of the floor element 11 but rather at an intermediate position wherein the structure is cantilevered from the pair of spaced horizontal support surfaces. The roof panel 12 may be connected to the floor panel 11 or to another horizontal support surface at its free end.

Figure 16A:
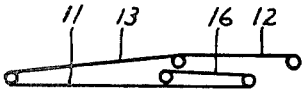
Figure 16B:
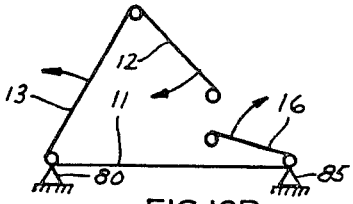
Figure 16C:
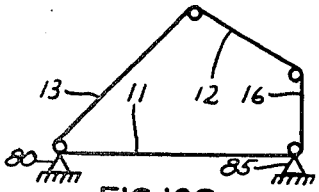

In FIG. 16, there is a module configuration which is folded and unfolded similar to that of FIG. 8, but a side wall panel 16 is hingedly attached to the one end of the floor panel 11 by hinge arrangement 59, similar to that as shown on FIG. 3. The side wall panel 16 is then folded upwardly, as shown on FIG. 16B, and its free end is attached to the free end of the roof panel 12, as shown on FIG. 16C. Of course, it will be understood that such a four-member structure is not inherently stable as that of the three-member structure and, therefore, some stabilizing structure, such as cross members or the like, must be employed.

Figure 17A:
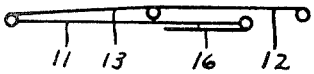
Figure 17B:
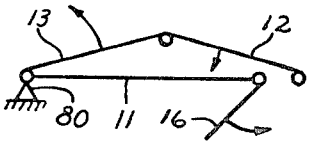
Figure 17C:
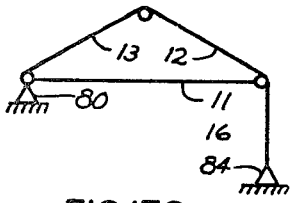

In FIG. 17, there is shown a similar building module, but the side wall panel 16 is attached to the floor panel 11 by way of a pivot arrangement 63, similar to that shown in FIG. 3, and the side wall element is folded in parallel relationship under the floor panel 11. The side wall panel 16 is then folded downwardly where it is attached to a suitable horizontal support surface 84.

Figure 18A:
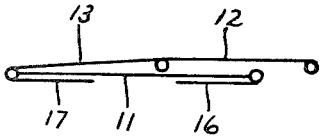
Figure 18B:
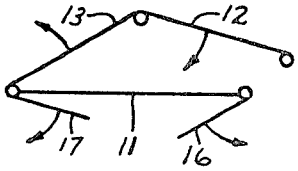
Figure 18C:
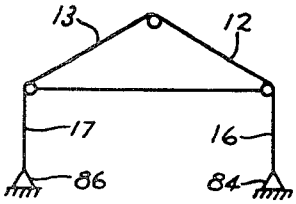

The configuration of FIG. 18 includes a second side wall panel 17 which is folded and unfolded in a manner similar to that of the side wall panel 16 and is attached to a horizontal support surface 86 which is preferably on the same horizontal level as that of the horizontal support surface 84 to form a building structure as shown in FIG. 18C.

Figure 19A:
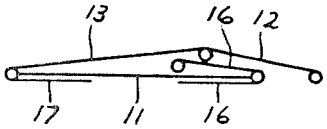
Figure 19B:
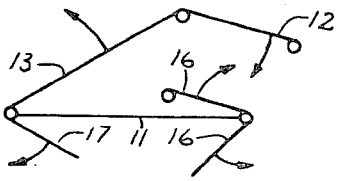
Figure 19C:
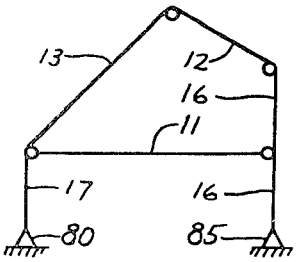

In FIG. 19, there is shown a building module which combines the features of the FIG. 16 and the FIG. 18 modules. The upper portion is thus folded, unfolded, and erected in a manner similar to that as shown in FIG. 16, and the lower portion thereof is folded and unfolded and erected in a manner as shown in FIG. 18.

Figure 20A:
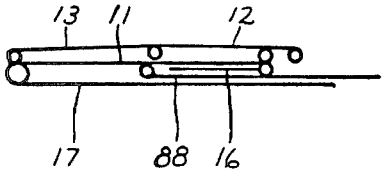
FIGS. 8–21 are schematic illustrations of the present invention in its folded, unfolding, and erected positions.
Figure 20B:
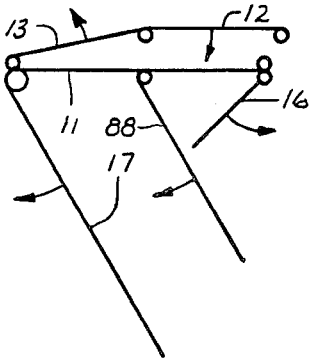
Figure 20C:
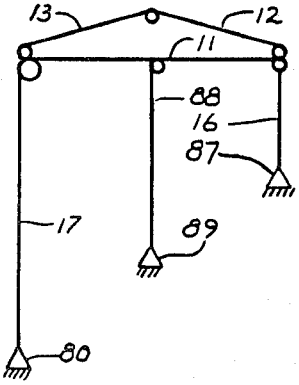

In FIG. 20, there is shown a module having wall elements 16 and 17 of different lengths to accommodate a structure having horizontal support surfaces 80 and 87 which are not on the same horizontal plane. A third wall element 88 of a selected length is provided to fold down to act as an internal wall and may be attached to a third horizontal support surface 89. It should be recognized that the number and lengths of the various wall elements may be selected and varied to accommodate the desired building design requirements.

Figure 21A:
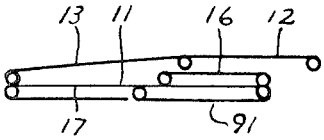
Figure 21B:
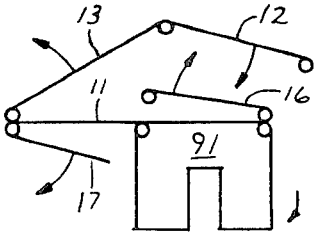
Figure 21C:
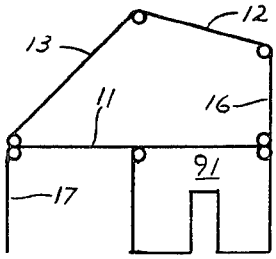

In FIG. 21, there is, in addition to the various elements that are rotated about parallel axes, a wall element 91 which is rotated about an axis which is normal to the axes of the other wall elements to form a front wall section, as shown in FIG. 21C. The size, position, and method of attachment of this element can, of course, be varied as desired.

The invention, as described hereinabove, includes specific details to enable one skilled in the art to practice the apparatus and the method of construction and erection. However, it should be recognized that these details may be varied while remaining within the scope of the invention as it is more broadly contemplated.

Having thus described the invention, what is claimed as novel and desired to be secured by Letters Patent of the United States is:

1. An improved building module of the type having a plurality of structural elements pivotably connected and folded together for movement to a building site for erection, comprising:

(a) a floor element having first and second ends and being adapted for placement on horizontal support means;

(b) first and second roof elements each having first and second ends;

(c) first pivot means for pivotably connecting said floor first end and said first roof element first end;

(d) second pivot means for pivotably connecting said first roof element second end to said second roof element first end; said second roof element having its second end free and being pivotable about said second pivot means from a first folded position substantially parallel to said floor element, and said first roof element being pivotable about said first pivot means, to form in combination an angled roof component which is vertically supported in part by said first pivot means; and (e) means for connecting said second roof element to said floor element second end to provide a stable, three-member structure, whereby said floor element is adapted to rest on the horizontal support means so as to provide the entire vertical support for said first and second roof elements and also act as a tensile member to restrain said first roof element first end and said second roof element second end from lateral separation.

2. An improved building module as set forth in claim 1 wherein said first roof element is pivotable from a folded position substantially parallel with said floor element.

3. An improved building module as set forth in claim 2 wherein said second roof element is pivotable from a first folded position substantially parallel with said first roof element.

4. An improved building module as set forth in claim 2 wherein said first and second roof elements, when in the folded position, are in substantial planar relative relationship.

5. An improved building module as set forth in claim 1 wherein said first roof element is pivotable from a folded position of substantial planar relative relationship with said floor element.

6. An improved building module as set forth in claim 1 and including at least one wall element having first and second ends, said first end being connected by a third pivot means to said floor element such that said at least one wall element is pivotable from a folded position substantially parallel to said floor element to a substantially vertical erected position depending from said floor element.

7. An improved building module as set forth in claim 6 and including means for connecting said at least one wall element second end to a base.

8. An improved building module as set forth in claim 6 wherein said at least one wall element is connected to one end of said floor element.

9. An improved building module as set forth in claim 6 and including at least two wall elements being connected at their first ends by wall pivot means to said floor element so as to be pivotable from folded positions substantially parallel to said floor element to substantially vertical erected positions depending from said floor element.

10. An improved building module as set forth in claim 9 wherein said at least two wall elements are connected at opposite ends of said floor element.

11. An improved building module as set forth in claim 9 and including means for connecting said at least two wall elements to a base.

12. An improved building module as set forth in claim 1 and including at least one wall element having first and second ends, said first end being connected by a third pivot means to said floor element such that said at least one wall element is pivotable from a folded position substantially parallel to said floor element to a substantially vertical erected position extending vertically upwardly from said floor element.

13. An improved building module as set forth in claim 12 and including fastening means for connecting said wall element second end to said second roof element second end.

14. An improved building module as set forth in claim 6 wherein said third pivot means has an axis parallel to those of said first and second pivot means.

15. An improved building module as set forth in claim 6 wherein said third pivot means has an axis that is substantially normal to those of said first and second pivot means.

16. An improved building module as set forth in claim 1 wherein said horizontal support is separate from either of said first and second roof elements.

17. A method of constructing a building structure having floor and roof components, comprising the steps of:

(a) providing at least one horizontal support surface;

(b) placing on said support surface a folded building module comprising a floor element and first and second roof elements, said first roof element being pivotably connected by a first pivot at its first end to a second end of said floor element and by a second pivot at its second end to a first end of said second roof element, and at least one of said first and second roof elements being disposed in parallel relationship with said floor element and with said floor element resting on said at least one horizontal support surface;

(c) pivoting said first roof element about said first pivot and said second roof element about said second pivot so that together they form an angled roof component; and (d) connecting said second roof element to said floor element second end to provide a stable, three-member structure, whereby said floor element acts as a tensile member to restrain said first roof element first end and said second roof element second end from lateral separation.

18. A construction method as set forth in claim 14 wherein said pivoting steps are accomplished by pivoting said first roof element in a counterclockwise direction and said second roof element in the clockwise direction.

19. A construction method as set forth in claim 14 wherein said pivoting steps are accomplished by pivoting said first roof element counterclockwise and said second roof element clockwise.

20. A construction method as set forth in claim 14 wherein said pivoting steps are accomplished by pivoting said first roof element clockwise and said second roof element counterclockwise.

21. A construction method as set forth in claim 17, wherein the step of placing the folded building module on said support surface includes the step of placing said first and second roof elements in substantial planar relative relationship.

22. A construction method as set forth in claim 17, wherein the step of placing said folded building module on said support surface includes the step of placing said first and second roof elements in substantial parallel relative relationship.

23. A construction method as set forth in claim 17, wherein the step of providing at least one horizontal support is accomplished by providing a pair of spaced support surfaces and said placing step is accomplished by placing said folded building module with the two ends of its floor element on the respective two support surfaces.

24. A construction method as set forth in claim 17, wherein said step of placing said folded building module on said support surface is accomplished by placing on said at least one horizontal support surface said floor element at a point intermediate its two ends.

25. A construction method as set forth in claim 17, wherein said pivoting step is continued until the vertical plane of said second pivot passes through the horizontal span of said at least one horizontal support surface.

26. A construction method as set forth in claim 17, wherein said pivoting step is continued until the vertical plane of said first pivot is between that of said second pivot and that of at least one horizontal support surface.

27. A construction method as set forth in claim 17, wherein said pivoting step is continued until said second pivot is disposed in substantially the same vertical plane as one of said at least one horizontal support surface.

28. A construction method as set forth in claim 17, wherein said pivoting step is continued until the vertical plane of said roof-support element is disposed between those of said first and second pivots.

* * * * *